US005433265A

United States Patent [19]

Rahmfeld et al.

[11] Patent Number: 5,433,265

[45] Date of Patent: Jul. 18, 1995

[54] BILLET GUIDE FRAME

[75] Inventors: Werner Rahmfeld, Mülheim; Rüdiger Heine, Duisburg; Dietmar Lohse, Wesel, all of Germany

[73] Assignee: Mannesmann Aktiengesellschaft, Dusseldorf, Germany

[21] Appl. No.: 202,441

[22] Filed: Feb. 28, 1994

[30] Foreign Application Priority Data

Feb. 26, 1993 [DE] Germany ..... 43 06 853.7

[51] Int. Cl.[6] ..... B22D 11/128

[52] U.S. Cl. ..... 164/447; 164/441

[58] Field of Search ..... 164/447, 448, 441, 442

[56] References Cited

FOREIGN PATENT DOCUMENTS 194656 9/1986 European Pat. Off. ..... 164/448

1166044 10/1969 United Kingdom ..... 164/448

*Primary Examiner*—Kuang Y. Lin

*Attorney, Agent, or Firm*—Cohen, Pontani, Lieberman, Pavane

[57] ABSTRACT

A billet guide in continuous casting installations for producing slabs, in particular according to the continuous casting and rolling process, including rollers which are located across from one another in pairs can be adjusted to different billet thicknesses, and are supported at frame pans of the billet guide. The frame pans are connected by tie rods which are formed by piston-cylinder units. Spacers are placed between the upper and lower frame pans in the flow of force of the piston-cylinder unit. A hydraulic ring cylinder is arranged between the spacers and the cylinder of the piston-cylinder unit and encloses the piston. The ring piston of the hydraulic ring cylinder supports the spacer in a frictional manner.

3 Claims, 2 Drawing Sheets

BILLET GUIDE FRAME

BACKGROUND OF THE INVENTION

1. Field of the Invention

The invention is directed to a billet guide, in particular for producing slabs, with supporting intervals which can be adjusted to different billet widths.

2. Description of the Invention

Billet guides in continuous casting installations are known from DE 26 12 094 A1. These billet guides have frame parts or stand parts which are connected across from one another in pairs by tie rods. Billet guide rollers are then supported at these frame parts or stand parts.

It is also known from DE 19 63 146 C1, to combine parts of the frame or stand for a plurality of rollers to form segments. The segment frames are formed by two yoke frames supporting the rollers and the yoke frames can be adjusted to the desired casting format by means of tie rods and spacers.

Additionally, DE 15 83 620 A1 teaches to use a billet guide frame formed from segments to deform the partially solidified billet in vertical straightening, bend straightening, and elbow installations. However, in this case, the yoke parts supporting the rollers are themselves supported and their position can be externally adjusted. In so doing, the first segment following the mold is held below the tnold in stationary pivot bearings and the adjusting devices act only on the lower side of the frame parts remote of the mold.

In conventional billet guide flames in elbow installations constructed as segments corresponding to the type described in DE 19 63 146 C1, the upper and lower frames of the segments are clamped relative to one another by means of four hydraulic differential cylinders which are arranged at the corners outside the billet path and connect the frames. Spacers which can be constructed as rotatable graduated disks or stepped disks are used to adjust to different billet thicknesses.

It is known from DE 40 22 894 C2 to adjust different intervals between the rollers of the supporting frame by providing a rotatable bushing with a helical or screw-shaped supporting surface as spacing means, an abutment associated with one of the frame parts being supported at this supporting surface. Since the angle of inclination of the screw-shaped supporting surface is very small, preferably smaller than the permissible friction angle, the adjustment paths are also small so as to allow for, e.g., billet shrinkage in adjusting the distance between the rollers.

In all of these constructions, including the latter, it is impossible to change the spacing between the rollers during the casting process due to the construction or, if the guide frames are also supposed to bring about a deformation (continuous casting and rolling) of the billet, to adjust the spacing between the rollers in a reproducible manner under the prevailing deformation forces.

SUMMARY OF THE INVENTION

Accordingly, it is an object of the present invention to provide a billet guide in which it is possible to adjust guide rollers in three defined positions, particularly in the continuous casting and rolling of thin slabs in the partially solidified region.

Pursuant to this object, and others which will become apparent hereafter, one aspect of the present invention resides in a billet guide having upper and lower frame parts connected by piston-cylinder units. Rollers are located across from one another in pairs and are mounted in the frame parts. Spacers are arranged between the upper and lower frame parts and a hydraulic ring cylinder is arranged between the spacer and the cylinder of the piston-cylinder unit so as to enclose the piston rod of the piston-cylinder unit. The ring cylinder has a ring piston that frictionally supports the spacer and has an adjusting path that is dimensioned so that the ring cylinder fixes the frame parts at a distance between the rollers corresponding to the desired billet thickness. This fixing of distance is accomplished by relieving the pressure in the ring cylinder.

The device according to the invention realizes its objectives in that two positions can be adjusted by means of the upper and lower position of the hydraulic differential cylinder and the third position is made possible by incorporating the additional integrated hydraulic plunger cylinder.

In the continuous casting and rolling process, when the billet has a liquid core it is first deformed frown the initial format of the mold to an intermediate size in the first segment of the billet guide downstream of the mold. In segments of conventional design, the subsequent billet guides are adjusted in a fixed manner to this intermediate size by means of the stepped disk. With a device according to the invention, it is now possible after changing the thickness of the billet in the first segment to also carry out changes in thickness in the following billet guide during the casting process. This is effected by actuating the plunger cylinder which is integrated in the region of the spacers. In this case, the segment frames in the billet guide are moved away from or toward one another in the required manner, always by a fixed amount which corresponds to the lift of the plunger cylinder and to the change in thickness in the first segment.

The three opening positions of the segments take into account the following points:

a) the upper position protects against destruction caused by a billet which may be solidifying in the installation (the segment is aerated);

b) the lower position, in which the plunger is moved in, serves as a clamping position of the upper frame of the segment on the spacers as a continuous casting and rolling position; and c) the third position, in which the plunger is moved out, is the position during initial casting. The magnitude of the interval between the rollers which is determined in so doing approximately corresponds to the billet format emerging from the mold. This magnitude must be retained in order to allow the cold billet head and the already cooled foot of the hot billet to pass through the deformation stand. As soon as the cold billet head leaves the billet guide segment in question, the plunger is switched to no-pressure and the upper and lower frames are adjusted to the definitive continuous casting and rolling dimension by means of the hydraulic differential cylinders.

The various features of novelty which characterize the invention are pointed out with particularity in the claims annexed to and forming a part of the disclosure. For a better understanding of the invention, its operating advantages, and specific object attained by its use, reference should be had to the drawing and descriptive matter in which there are illustrated and described preferred embodiments of the invention.

DETAILED DESCRIPTION OF THE PREFERRED EMBODIMENTS

Figure 1:
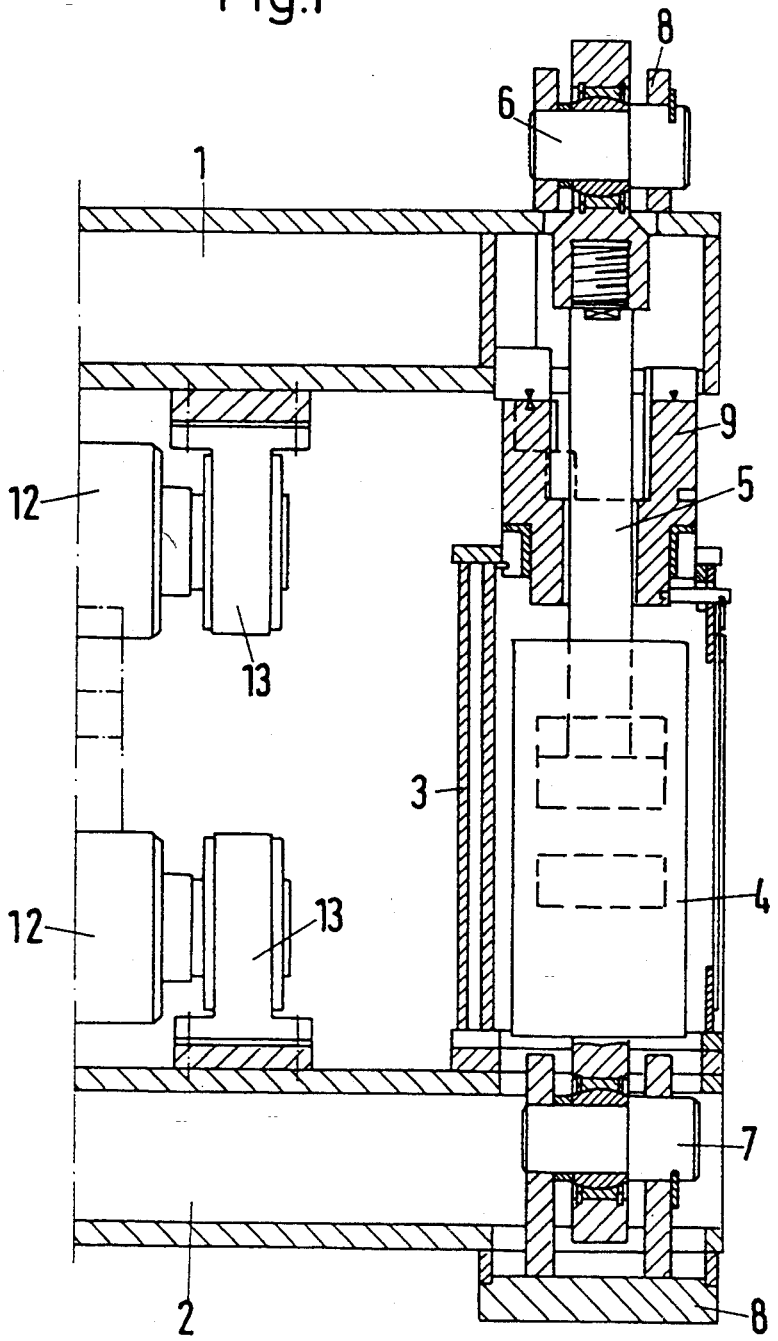
FIG. 1 shows a section through a conventional billet guide.

Identical parts are provided with the same reference numbers in the drawing. According to FIG. 1, rollers 12 are held on roller bearings 13 at an upper frame 1 and a lower frame 2. The upper frame 1 and the lower frame 2 are connected with one another via a piston-cylinder unit 4, 5. The piston rod 5 is thstened to the upper frame 1 by a joint bearing or swing beating 6 and the cylinder 4 is fastened to the lower frame 2 via a swing beating 7, respectively, at bearing fastenings 8. A spacer 9 is arranged between the upper frame 1 and a side frame 3 in the direction of the flow of force of the piston-cylinder unit 4, 5.

Figure 2:
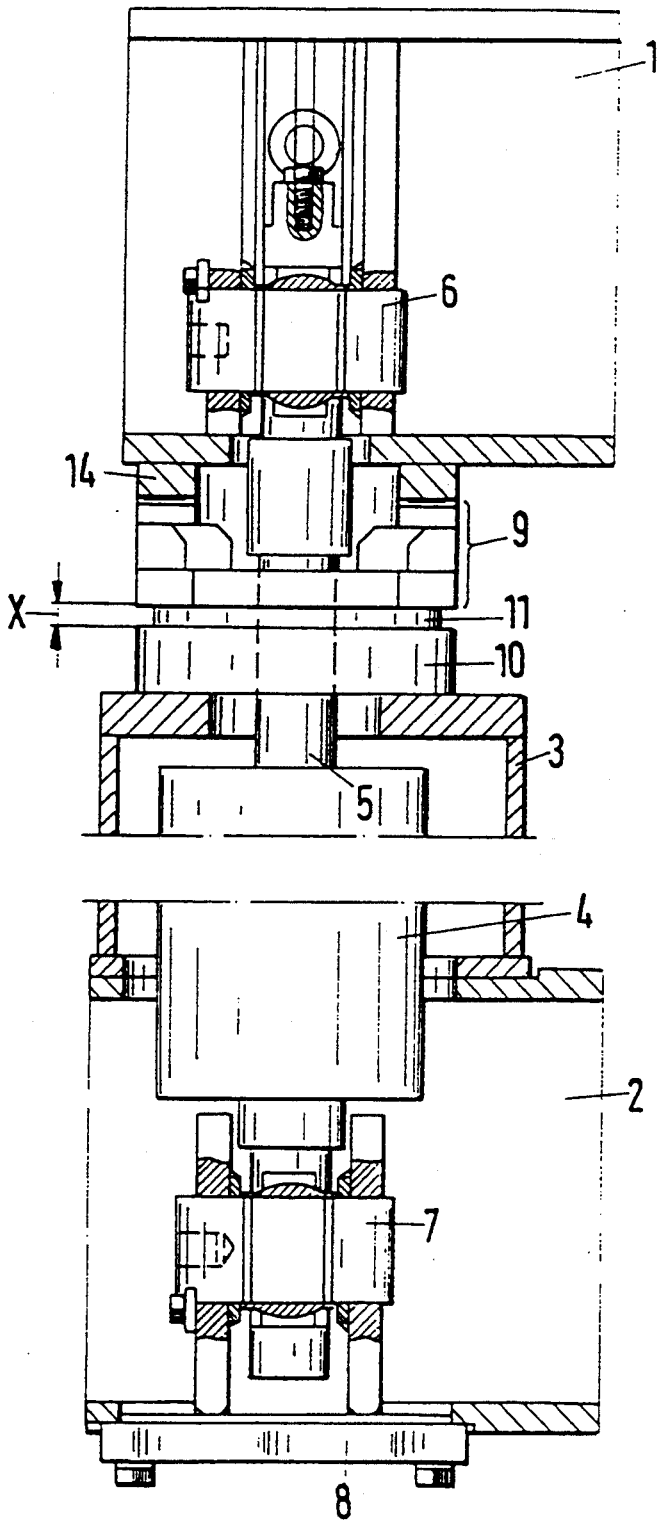
FIG. 2 shows a section through a device according to the invention.

FIG. 2 shows a basically identical construction of the device. The connection between the upper frame 1 and the lower frame 2 supporting the rollers is also produced in this case via the hydraulic cylinder 4 and the piston rod 5 and the swing bearings 6, 7. The spacer 9 is constructed in a known manner, per se, as a stepped disk, encloses the piston rod 5, and contacts a supporting surface 14 of the upper frame 1. According to the invention, a hydraulic plunger cylinder 10, 11 is arranged between the spacer 9 and the side frame 3. The adjusting path of the ring piston 11 is designated by "X".

The short-stroke hydraulic plunger cylinder 10, 11 is shown in an extended position in FIG. 2. This position fixes the greatest possible distance between a pair of rollers and corresponds to the position in initial casting until the cold billet head passes through. In order to achieve this position, the pressure force in the hydraulic plunger cylinder 10, 11 must be increased so that it overcomes the tensile force applied to the two frame parts 1, 2 by the piston-cylinder unit 4, 5. After the cold billet head passes through, the hydraulic plunger cylinder 10, 11 is relieved of pressure so that the adjusting path "X" is reduced to zero. The degree of deformation of the casting billet is fixed in this position at the same time.

The invention is not limited by the embodiments described above which are presented as examples only but can be modified in various ways within the scope of protection defined by the appended patent claims.

What is claimed is:

1. A billet guide in continuous casting installations for producing slabs, comprising: upper frame parts; lower frame parts; tie rods that connect the upper frame parts to the lower frame parts, each of the tie rods being formed by a piston-cylinder unit; rollers located across from one another in pairs and supported at the frame parts so as to be adjustable to different billet thicknesses; spacers arranged between the upper and lower frame parts in a force acting direction of the piston-cylinder unit; and a hydraulic ring cylinder arranged between each of the spacers and the cylinder of the piston-cylinder unit so as to enclose the piston rod of the piston-cylinder unit, the ring cylinder having a ring piston that supports the spacer frictionally, the ring piston having an adjusting path dimensioned so that the hydraulic ring cylinder, when relieved of pressure, fixes the frame parts at a distance between the rollers which corresponds to a desired billet thickness.

2. A billet guide according to claim 1, and further comprising side frames that connect at least two lower frame parts to form a billet guide segment, the hydraulic ring cylinder being supported on the side frame.

3. A billet guide according to claim 1, wherein the piston rod is connected to the upper frame part by a swing bearing and the cylinder is connected to the lower frame by a swing bearing.

* * * * *